US006480189B1

(12) United States Patent
Ide

(10) Patent No.: US 6,480,189 B1
(45) Date of Patent: Nov. 12, 2002

(54) DISPLAY PANEL DRIVING APPARATUS

(75) Inventor: Shigeo Ide, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/516,954

(22) Filed: Mar. 1, 2000

(30) Foreign Application Priority Data

Mar. 1, 1999 (JP) ..... 11-052915

(51) Int. Cl.[7] ..... G09G 5/00
(52) U.S. Cl. ..... 345/211; 345/60
(58) Field of Search ..... 345/60, 204, 205, 345/211, 212, 94, 95, 96, 208, 209, 210

(56) References Cited

U.S. PATENT DOCUMENTS 5,438,290 A * 8/1995 Tanaka ..... 327/108
6,314,005 B1 * 11/2001 Nishi et al. ..... 363/21.08

OTHER PUBLICATIONS

Robert L. Riddle & Marlin P. Ristenbatt, Transistor Physics and Circuits, 1958, Prentice–Hall, Inc., LICCCN 57–14923, p. 98.*

* cited by examiner

*Primary Examiner*—Kent Chang
*Assistant Examiner*—Tom V Sheng
(74) *Attorney, Agent, or Firm*—Sughrue Mion, PLLC

(57) ABSTRACT

A driving apparatus for a display panel having a plurality of row electrodes and a plurality of column electrodes intersecting the row electrodes, for generating a drive pulse to be applied to each of the electrodes. The driving apparatus includes a DC power supply for generating a DC voltage and having a positive terminal and a negative terminal one of which is applied with a reference potential, a coil having one end connected to the other terminal of the DC power supply, and a switching arrangement for alternately making a connection and disconnection between the one end of the coil and the other terminal of the DC power supply. At the time the alternate switching is performed, a potential change appearing on the other end of the coil is used as the drive pulse.

4 Claims, 12 Drawing Sheets

SWITCHING SIGNAL

CURRENT i FLOWING ACROSS COIL L

POTENTIAL ON LINE 2

SWITCHING SIGNAL S0
1
0
OFF
ON
OFF
ON
OFF

CURRENT FLOWING ACCROSS COIL L21
0
RESONANCE OF L21 WITH C21 AND C0

POTENTIAL ON LINE Z21
VD
0

PIXEL DATA PULSE
1
0
OFF
ON
OFF

POTENTIAL ON ELECTRODE Z1
VD
0

DISPLAY PANEL DRIVING APPARATUS

BACKGROUND OF THE INVENTION

1. Field of the Invention

The present invention relates to a driving apparatus for an AC drive type plasma display panel (hereinafter called "PDP") or a display panel having capacitive loads such as electroluminescence (hereinafter called "EL") elements.

2. Description of the Related Background Art

Display apparatuses which use flat panels display devices of a self-emitting type such as a PDP or EL panel, are manufactured as on-wall TV's.

FIG. 1 is a diagram showing a schematic structure of the display apparatus.

In FIG. 1, a PDP 10 has row electrodes $Y_1$ to $Y_n$ and row electrodes $X_1$ to $X_n$, each pair of which corresponds to a single one of rows of one screen (the first row to the n-th row). Further formed on the PDP 10 are column electrodes $Z_1$ to $Z_m$ which correspond to the respective columns of one screen (the first column to the m-th column) with an unillustrated dielectric layer and discharge space provided in between and which run perpendicular to those row electrode pairs. A single discharge cell C(i,j) is formed at each intersection of one pair of row electrodes (X, Y) and a single column electrode Z.

A row electrode driver 30 first generates reset pulses $RP_Y$ of a positive voltage as shown in FIG. 2 and simultaneously applies those pulses to the row electrodes $Y_1$–$Y_n$. At the same time, a row electrode driver 40 generates reset pulses $RP_x$ of a negative voltage and simultaneously applies those pulses to the row electrodes $X_1$–$X_n$.

The simultaneous application of those reset pulses $RP_x$ and $RP_y$ causes all the discharge cells of the PDP 10 to be excited and discharged, generating charge particles, and a predetermined amount of wall charges are evenly formed in the dielectric layers of the entire discharge cells after the discharging is finished (reset cycle).

After the reset cycle, a column electrode driver 20 generates pixel data pulses $DP_1$ to $DP_n$ respectively corresponding to the first row to the n-th row of the screen and sequentially applies the pixel data pulses to the column electrodes $Z_1$–$Z_m$ as shown in FIG. 2. In accordance with the application timing of the pixel data pulses $DP_1$–$DP_n$, the row electrode driver 30 generates a scan pulse SP of a negative voltage and sequentially applies the scan pulse SP to the row electrodes $Y_1$–$Y_n$, as shown in FIG. 2.

In any discharge cells in the row electrode to which the scan pulse SP has been applied, discharging occurs and most of the wall charges are lost. Those discharge cells are cells to which the pixel data pulses of a positive voltage have also been applied at the same time. Since no discharging occurs in those discharge cells which have been applied with the scan pulse SP but not the pixel data pulses of a positive voltage, the wall charges remain. The discharge cells in which the wall charges have stayed become light-emitting discharge cells while those from which the wall charges have been lost become non-emitting discharge cells (address cycle).

When the address cycle ends, the row electrode drivers 30 and 40 continuously apply sustain pulses $IP_y$ of a positive voltage to the row electrodes $Y_1$–$Y_n$ and continuously apply sustain pulses $IP_x$ of a positive voltage to the row electrodes $X_1$–$X_n$ at timings different from the application timings of the sustain pulses $IP_y$.

The light-emitting discharge cells where the wall charges have remained repeat discharge emission and maintain the light emission over a period in which the sustain pulses $IP_x$ and $IP_y$ are alternately applied (sustain discharge cycle).

A drive control circuit 50 shown in FIG. 1 generates various switching signals for generating various drive pulses as shown in FIG. 2 based on the timing of supplied video signals and supplies the switching signals to the column electrode driver 20 and the row electrode drivers 30 and 40.

The column electrode driver 20 and the row electrode drivers 30 and 40 generate the various drive pulses shown in FIG. 2 according to the switching signals supplied from the drive control circuit 50.

FIG. 3 is a diagram illustrating a drive pulse generator which is provided in the row electrode driver 30 and generates the reset pulse $RP_y$ and the sustain pulse $IP_y$.

In FIG. 3, the drive pulse generator is provided with a capacitor C1 having one end grounded to a PDP ground potential $V_s$ as the ground potential of the PDP 10.

A switching element S1 is open when a switching signal SW1 having a logic level "0" is being supplied from the drive control circuit 50. When the logic level of the switching signal SW1 is "1", however, the switching element S1 is closed, thereby applying the potential produced on the other end of the capacitor C1 to a line 2 via a coil L1 and a diode D1. As a result, the capacitor C1 starts discharging and the potential generated by the discharge is applied to the line 2.

A switching element S2 is open when a switching signal SW2 having a logic level "0" is being supplied from the drive control circuit 50. When the logic level of the switching signal SW2 is "1", on the other hand, the switching element S2 is closed, thereby applying the potential on the line 2 to the other end of the capacitor C1 via a coil L2 and a diode D2. That is, the capacitor C1 is charged with the potential on the line 2.

A switching element S3 is open when a switching signal SW3 of a logic level "0" is being supplied from the drive control circuit 50. When the logic level of the switching signal SW3 is "1", however, the switching element S3 is closed, thereby applying a positive terminal potential $V_c$ of a DC power supply B1 to the line 2. The negative terminal of the DC power supply B1 is applied with the PDP ground potential $V_s$.

A switching element S4 is open when a switching signal SW4 of a logic level "0" is being supplied from the drive control circuit 50. When the logic level of the switching signal SW4 is "1", the switching element S4 is closed, thereby applying the PDP ground potential $V_s$ to the line 2.

The line 2 is connected to the row electrodes Y of the PDP 10 which has a capacitive element CO. That is, n circuits each as shown in FIG. 3 corresponding to the row electrodes $Y_1$–$Y_n$ are provided in the row electrode driver 30.

FIG. 4 is a diagram showing timing of the switching signals SW1–SW4 which the drive control circuit 50 supplies to the row electrode driver 30 shown in FIG. 3 in order to produce the sustain pulse $IP_y$ shown in FIG. 2 on the line 2.

As shown in FIG. 4, since only the switching signal SW4 of the switching signals SW1–SW4 has a logic level "1" first, the switching element S4 is closed to apply the PDP ground potential $V_s$ to the line 2. During the period, the potential on the line 2 is the PDP ground potential Vs, i.e., 0 V.

When the logic levels of the switching signals SW4 and SW1 are respectively switched to "0" and "1", only the switching element S1 is closed, causing the charges stored in the capacitor C1 to be discharged. Consequently, the current transiently flows across the coil L1 with a waveform as illustrated in FIG. 4. The current flows into the PDP 10 through the diode D1, the switching element S1 and the line 2, so that the capacitive element $C_0$ is charged. The potential on the line 2 gradually increases as shown in FIG. 4.

When the logic levels of the switching signals SW1 and SW3 are respectively switched to "0" and "1", only the switching element S3 is closed, so that the positive terminal potential $V_c$ of a DC power supply B1 is applied to the line 2. Consequently, the potential on the line 2 is fixed to $V_c$ as shown in FIG. 4.

When the logic levels of the switching signals SW2 and SW3 are respectively switched to "1" and "0", only the switching element S2 is closed, so that a negative current transiently flows across the coil L2 with a waveform as illustrated in FIG. 4. That is, the capacitive element $C_0$ of the PDP 10 that has been charged in the above-described manner discharges and its current flows into the capacitor C1 through the line 2, the coil L2, the diode D2 and the switching element S2 and is stored there. As a result, the potential on the line 2 gradually decreases as shown in FIG. 4.

Through the above operation, the sustain pulse $IP_y$ of a positive voltage as shown in FIG. 4 is applied to the line 2.

As the structure illustrated in FIG. 3 needs four switching elements S1–S4, however, the circuit scale becomes disadvantageously large.

Further, the circuit cannot be used in generating the pixel data pulses to the column electrodes that demand a fast operation.

SUMMARY OF THE INVENTION

Accordingly, it is an object of the present invention to provide a driving apparatus for a display panel, which can operate fast with lower power consumption and with a simple structure.

According to the present invention, there is provided a driving apparatus for a display panel having a plurality of row electrodes and a plurality of column electrodes intersecting the row electrodes, for generating a drive pulse to be applied to each of the electrodes. The driving apparatus comprises a DC power supply for generating a DC voltage and having a positive terminal and a negative terminal one of which is applied with a reference potential; a coil having a first end connected to the other terminal of the DC power supply; and switching means for alternately making a connection and disconnection between the first end of the coil and the other terminal of the DC power supply, whereby a potential change appearing on a second end of the coil is used as the drive pulse.

DETAILED DESCRIPTION OF THE PREFERRED EMBODIMENTS

Figure 5:
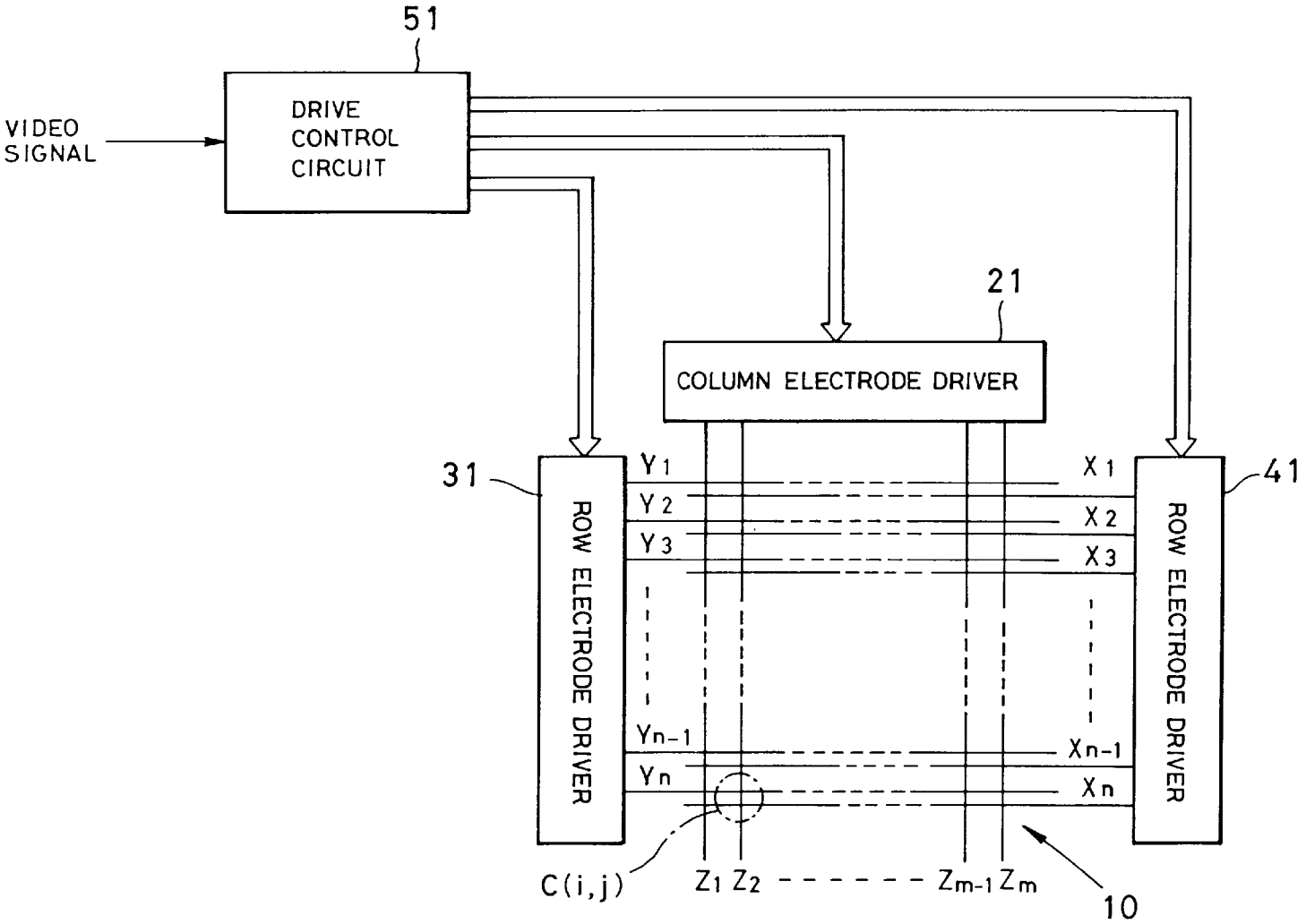
FIG. 5 is a diagram showing the schematic structure of a display apparatus equipped with a driving apparatus according to the present invention.

FIG. 5 shows the structure of a display apparatus equipped with a display panel driving apparatus according to the present invention.

In FIG. 5, a PDP 10 has row electrodes $Y_1$ to $Y_n$ and row electrodes $X_1$ to $X_n$, each pair of which corresponds to a single one of rows of one screen (the first row to the n-th row). Further formed on the PDP 10 are column electrodes $Z_1$ to $Z_m$ which correspond to the respective columns of one screen (the first column to the m-th column) with an unillustrated dielectric layer and discharge space provided in between and which run perpendicular to those row electrode pairs. A single discharge cell C(i,j) is formed at a intersection portion of one pair of row electrodes (X, Y) and a single column electrode Z.

Figure 1:
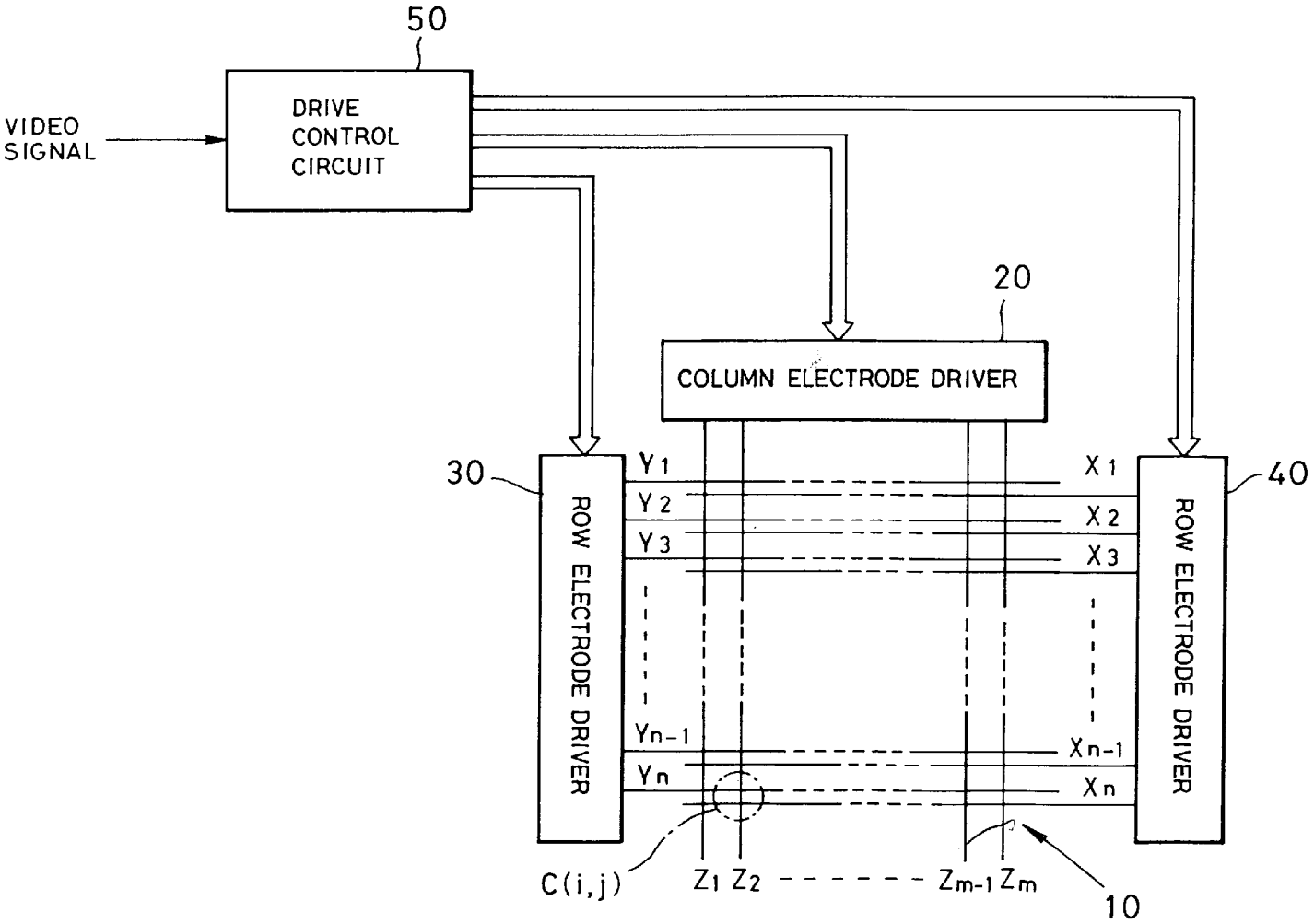
FIG. 1 is a diagram showing the schematic structure of a conventional display apparatus using a self-emitting type flat panel.
Figure 2:
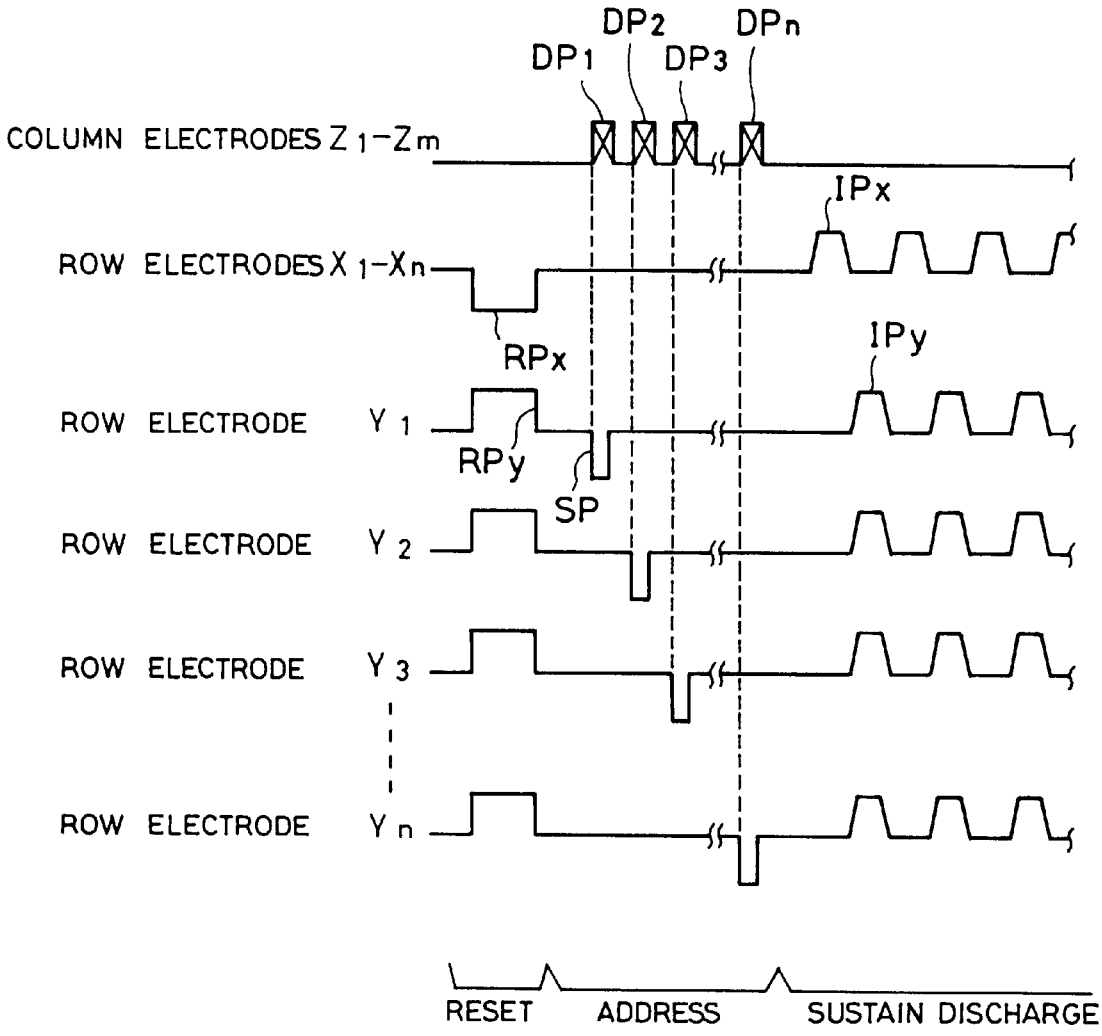
FIG. 2 is a diagram illustrating the timings at which various kinds of drive pulses are applied.

A row electrode driver 31 generates reset pulses $RP_y$ of a positive voltage, scan pulses SP of a negative voltage and sustain pulses $IP_y$ as shown in FIG. 2 and simultaneously applies those pulses to the row electrodes $Y_1$–$Y_n$ at the timings illustrated in FIG. 2. A row electrode driver 41 generates reset pulses $RP_x$, of a negative voltage and sustain pulse $IP_x$ of a positive voltage as shown in FIG. 2 and applies those pulses to the row electrodes $X_1$–$X_n$ at the timings shown in FIG. 2.

The column electrode driver 21 generates pixel data pulses $DP_1$ to $DP_n$ according to pixel data corresponding to the first to n-th rows of the screen and sequentially applies those pulses to the column electrodes $Z_1$–$Z_n$ as shown in FIG. 2.

A drive control circuit 51 generates various switching signals for producing individual drive pulses shown in FIG. 2 based on supplied video signals, and sends those switching signals to the column electrode driver 21 and the row electrode drivers 31 and 41.

Figure 6:
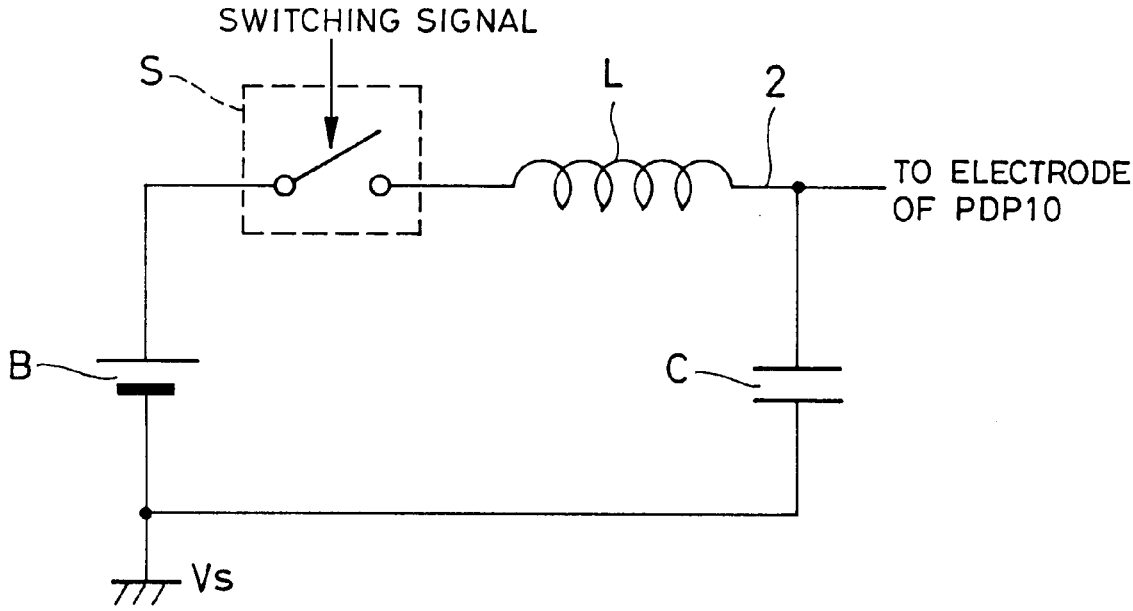
FIG. 6 is a diagram illustrating a pulse generator as the driving apparatus according to the present invention.

A pulse generator as the driving apparatus embodying the invention as illustrated in FIG. 6 is provided in each of those column electrode driver 21 and the row electrode drivers 31 and 41.

Referring to FIG. 6, the negative terminal of a DC power supply B which generates a DC voltage is grounded to a PDP ground potential $V_s$ or the ground potential of the PDP 10. The positive terminal of the DC power supply B is connected to a line 2 via a series circuit of a switching element S and a coil L. The line 2 reaches the individual electrodes (row electrodes and column electrodes) of the PDP 10. A capacitor C is connected between the line 2 and the negative terminal of the DC power supply B or the ground. A capacitive element $C_0$ of the PDP 10, though not shown in FIG. 6, is present between the line 2 and the ground. When the capacitance of the capacitive element $C_0$ is large, the capacitor C is not essential.

The operation of the pulse generator with the above structure will now be described by referring to FIGS. 7A to 7C, 8A and 8B.

Figures 7A, 7B, 7C:
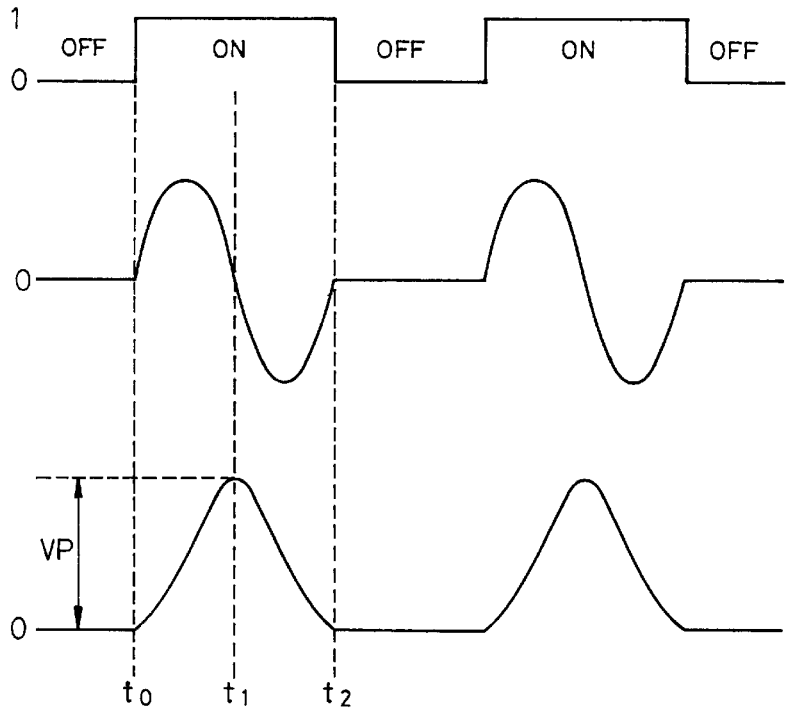
FIGS. 7A to 7C are diagrams illustrating the operational waveforms of the pulse generator shown in FIG. 6.

First, immediately before time $t_0$ shown in FIGS. 7A to 7C, the switching signal supplied from the drive control circuit 51 has a logic level "0" and the switching element S is off, as shown in FIG. 7A. When the logic level of the switching signal is inverted to "1" from "0" at time $t_o$, the switching element S becomes on. With the switching element S being on, a resonance circuit is formed which has a series circuit of the coil L and the capacitor C connected between both terminals of the DC power supply B. Therefore, the current flows out of the positive terminal of the DC power supply B into the negative terminal thereof via the switching element S, the coil L and the capacitor C as indicated by an arrow in FIG. 8A. Part of the current that comes out of the coil L flows to the ground via the capacitive element $C_0$ of the PDP 10, and then goes to the negative terminal of the DC power supply B. As shown in FIG. 7B, the current i that flows across the coil L gradually increases from time $t_0$ at which the ON-duration of the switching element S has started until it reaches a positive peak current value. After that, the current i flows as a resonance current to the capacitor C and the capacitive element $C_0$ of the PDP 10 from the coil L, so that it gradually decreases. The potential on the line 2 gradually increases from 0 V of the time $t_0$ and becomes a peak voltage VP at time $t_1$ at which the current i decreases to 0 as shown in FIG. 7C. The peak voltage VP is higher than the output voltage of the DC power supply B.

Figure 8A:
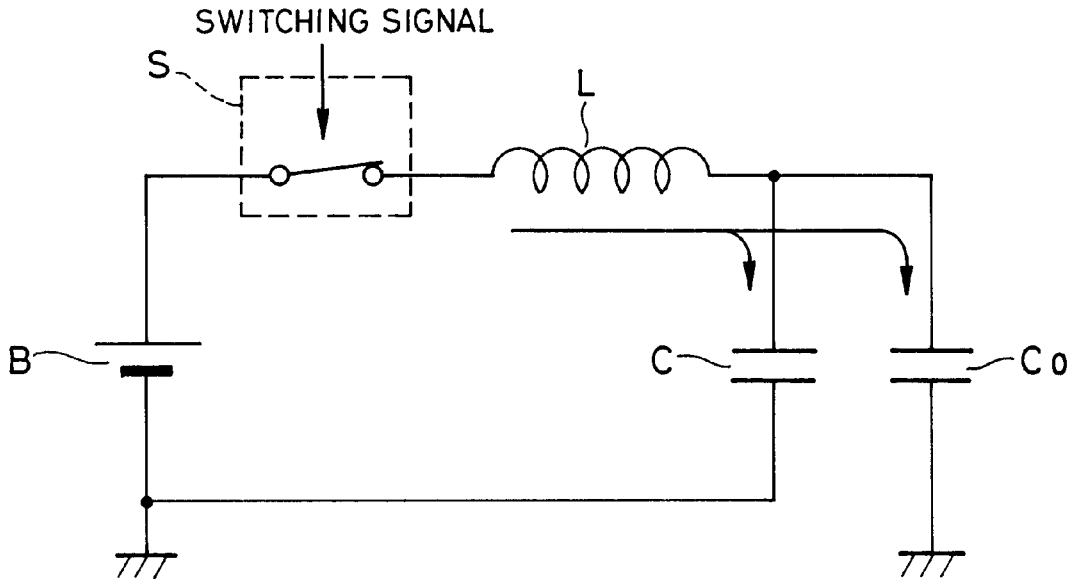
FIGS. 8A and 8B are diagrams for explaining the operation of the pulse generator shown in FIG. 6.
Figure 8B:
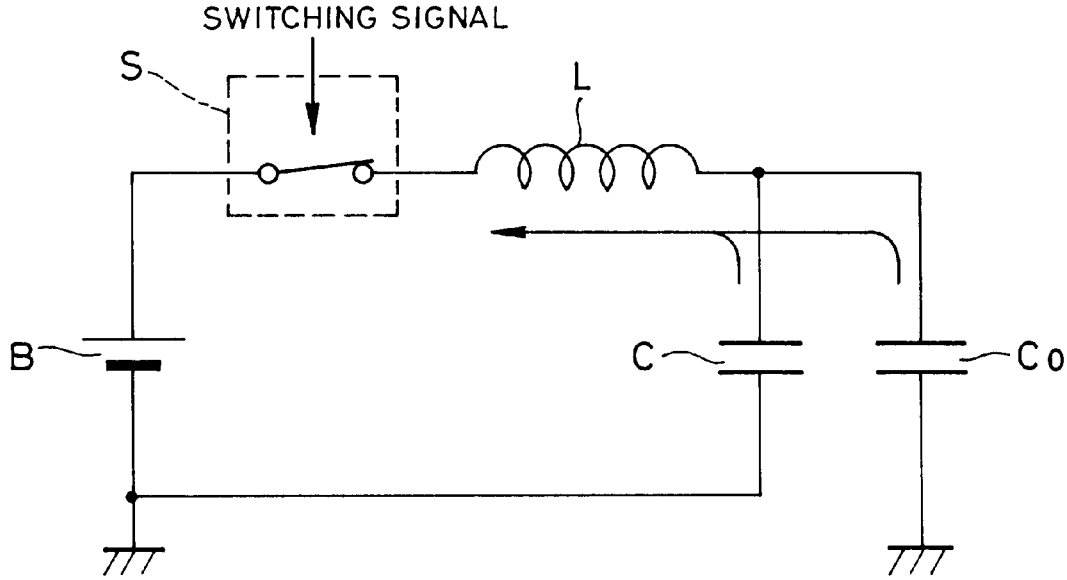

After the time $t_1$ the energy stored in the capacitor C and the capacitive element $C_0$ of the PDP 10 causes a resonance current to flow from the capacitor C and the capacitive element $C_0$ toward the coil L as indicated by an arrow in FIG. 8B. The current i that flows across the coil L in the reverse direction gradually decreases from the time $t_1$ at which the ON-duration of the switching element S has started, and becomes larger on the negative side. When the current i reaches a negative peak current value, the electromagnetic energy of the coil L flows as the current to be returned to the power supply B, gradually increasing the current i. The potential on the line 2 gradually drops from the time $t_1$ and becomes 0 V at time $t_2$ at which the current i having increased from the negative side reaches 0.

At the time $t_2$, the logic level of the switching signal supplied from the drive control circuit 51 becomes "0", setting the switching element S off.

As the switching element S repeats the ON and OFF states, the pulse generator repeatedly performs the above-described operation, so that a sinusoidal pulse GP having a peak value VP is generated as shown in FIG. 7C. The peak value VP is higher than the value of the voltage generated by the DC power supply B.

The pulse GP generator can be used as a generator to generate any one of the sustain pulses $IP_y$ and $IP_x$ and the pixel data pulses DP shown in FIG. 2.

Figure 9:
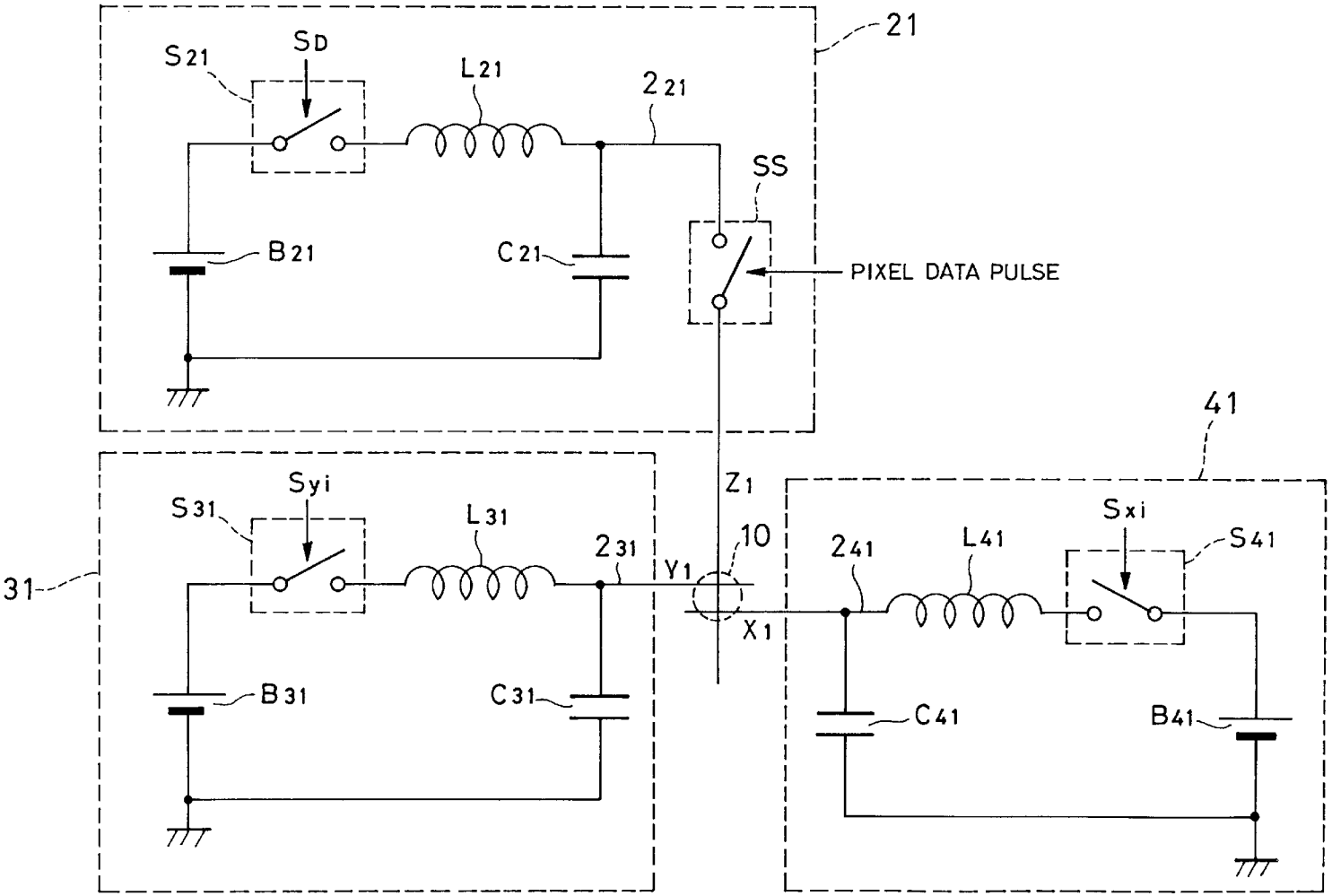
FIG. 9 is a diagram exemplifying a case where the pulse generator shown in FIG. 6 is adapted as a sustain pulse generator in each of row electrode drivers 31 and 41 and a pixel data pulse generator in a column electrode driver 21.

FIG. 9 is a diagram exemplifying the case where the pulse generator shown in FIG. 6 is adapted as a sustain pulse $IP_y$ generator in the row electrode driver 31, a sustain pulse $IP_x$ generator in the row electrode driver 41 and a pixel data pulse DP generator in the column electrode driver 21. In association with the DC power supply B, the switching element S, the coil L and the capacitor C shown in FIG. 6, the row electrode driver 31 is provided with a power supply $B_{31}$, a switching element $S_{31}$, a coil $L_{31}$ and a capacitor $C_{31}$, the row electrode driver 41 is provided with a power supply $B_{41}$, a switching element $S_{41}$, a coil $L_{41}$ and a capacitor $C_{41}$, and the column electrode driver 21 is provided with a power supply $B_{21}$, a switching element $S_{21}$, a coil $L_{21}$ and a capacitor $C_{21}$.

FIG. 9 illustrates only those portions which drive the row electrodes $X_1$ and $Y_1$ and the column electrode $Z_1$ among all the electrodes of the PDP 10.

Figures 10A, 10B, 10C, 10D, 10E, 10F:
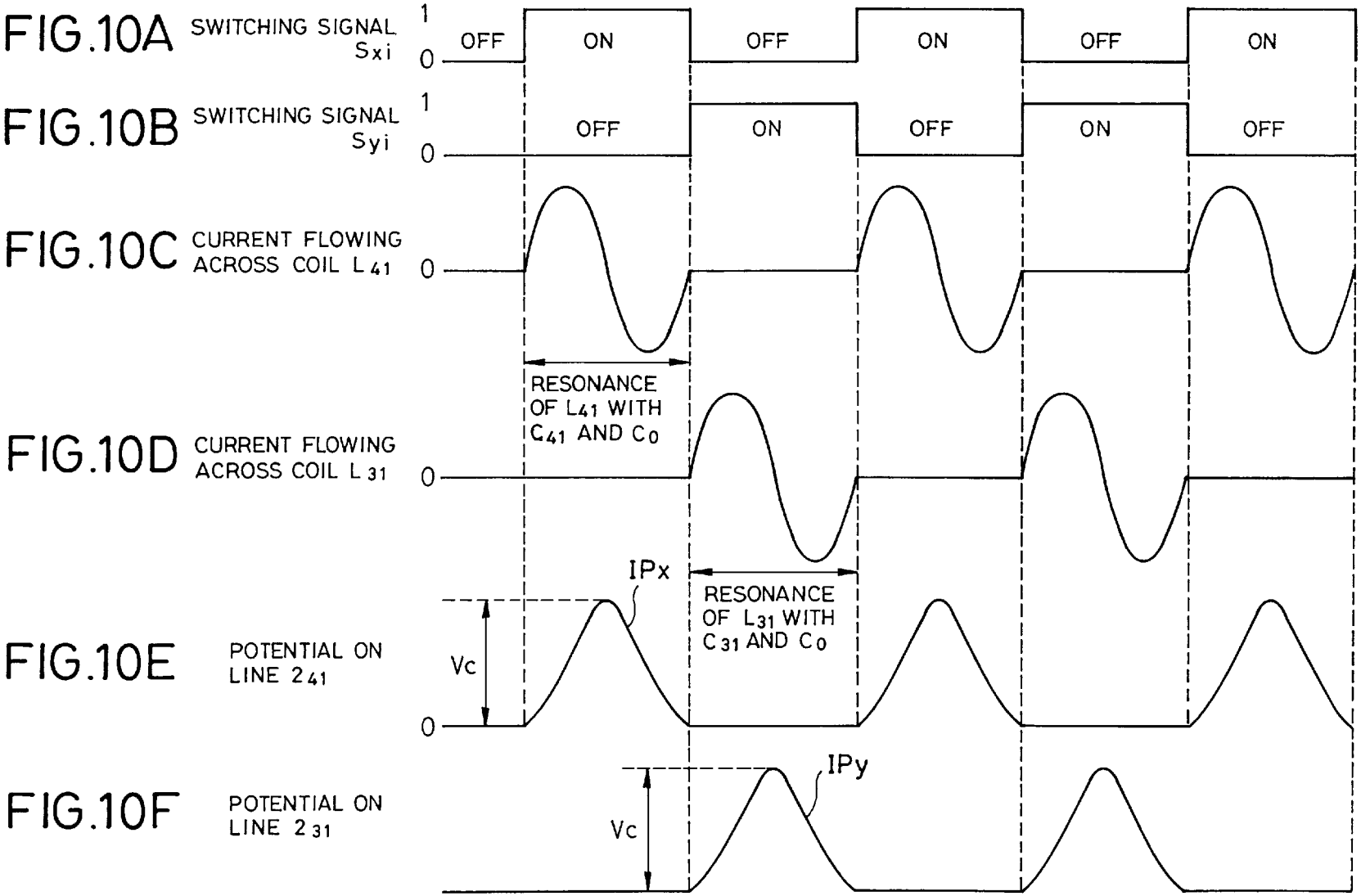
FIGS. 10A to 10F are diagrams illustrating the operational waveforms at the time sustain pulses $IP_x$ and $IP_y$ are generated in the row electrode drivers 41 and 31 shown in FIG. 9.

In generating the sustain pulse $IP_x$ ,the drive control circuit 51 supplies a switching signal $S_{xi}$ whose logic level is repeatedly switched between "0" and "1" as shown in FIG. 10A to the switching element $S_{41}$ in the row electrode driver 41 shown in FIG. 9. This causes the current to flow across the coil $L_{41}$ as shown in FIG. 10C due to the resonance action of the coil $L_{41}$, the capacitor $C_{41}$ and the capacitive element $C_0$ of the PDP 10 so that the sinusoidal sustain pulse $IP_x$ having a peak value $V_c$ is repeatedly generated as shown in FIG. 10E. The sustain pulse $IP_x$ is applied to the row electrode $X_1$. At the time, the voltage value of the DC power supply $B_{41}$ in the pulse generator provided in the row electrode driver 41 can be lower than the peak value $V_c$.

In generating the sustain pulse $IP_y$ the drive control circuit 51 supplies a switching signal $S_{yi}$ whose logic level is repeatedly switched between "0" and "1" as shown in FIG. 10B to the switching element $S_{31}$ in the row electrode driver 31 shown in FIG. 9. This causes the current to flow across the coil $L_{31}$ as shown in FIG. 10D due to the resonance action of the coil $L_{31}$, the capacitor $C_{31}$ and the capacitive element $C_0$ of the PDP 10 so that the sinusoidal sustain pulse $IP_y$ having a peak value $V_c$ is repeatedly generated as shown in FIG. 10F. The sustain pulse $IP_y$ is applied to the row electrode $Y_1$. At the time, the voltage value of the DC power supply $B_{31}$ in the pulse generator provided in the row electrode driver 31 can be lower than the peak value $V_c$.

Figures 11A, 11B, 11C, 11D, 11E:
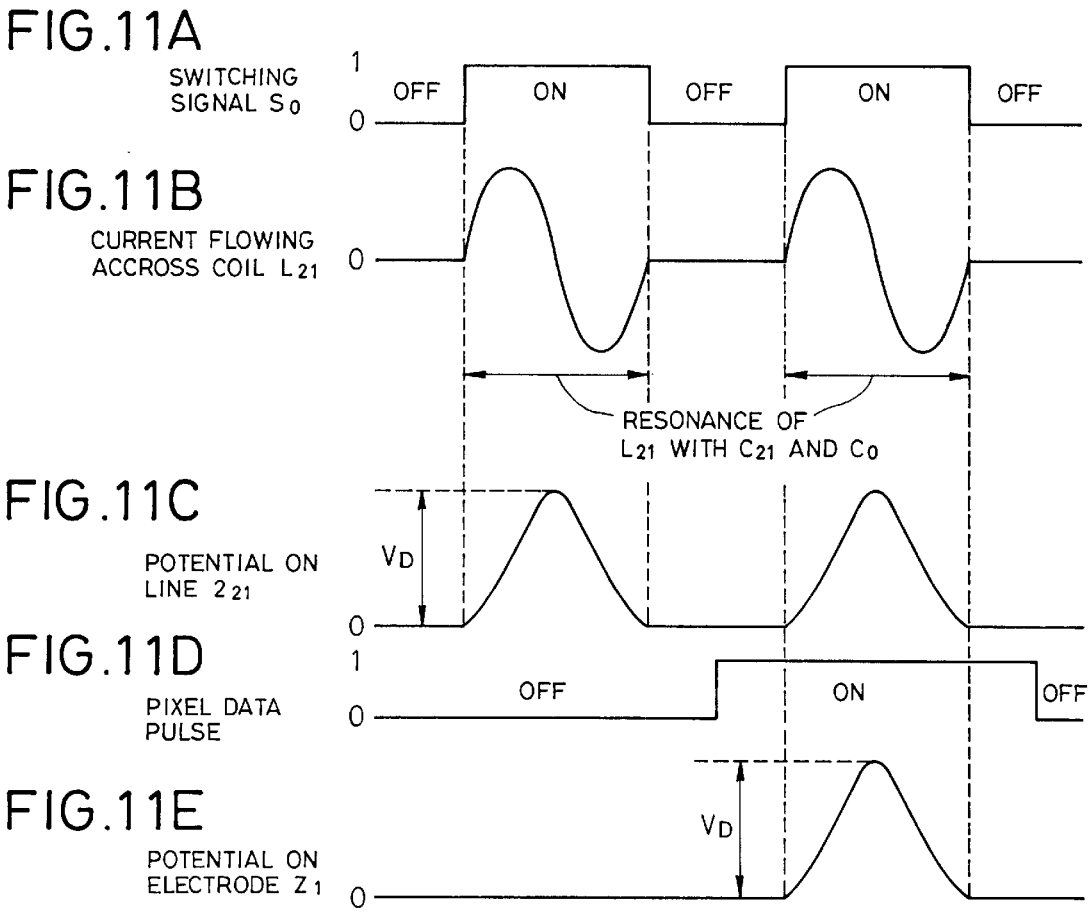
FIGS. 11A to 11E are diagrams illustrating the operational waveforms at the time pixel data pulses DP are generated in the column electrode driver 21 shown in FIG. 9.

In generating the pixel data pulse DP, the drive control circuit 51 supplies a switching signal $S_D$ whose logic level is repeatedly switched between "0" and "1" as shown in FIG. 11A to the switching element $S_{21}$ in the column electrode driver 21 shown in FIG. 9. As a result, the current flows across the coil $L_{21}$ as shown in FIG. 11B due to the resonance action of the coil $L_{21}$, the capacitor $C_{21}$, and the capacitive element $C_0$ of the PDP 10 so that the sinusoidal pulse having a peak value $V_D$ is repeatedly generated on the line $\mathbf{2}_{21}$ as shown in FIG. 11C. A switching element SS becomes on only when pixel data having a logic level "1" as shown in FIG. 11D is supplied, thereby applying the pulse generated on the line $\mathbf{2}_{21}$ to the column electrode $Z_1$ as the pixel data pulse DP as shown in FIG. 11E. At the time, the voltage value of the DC power supply $B_{21}$ in the pulse generator provided in the column electrode driver 21 can be lower than the peak value $V_D$.

Figure 3:
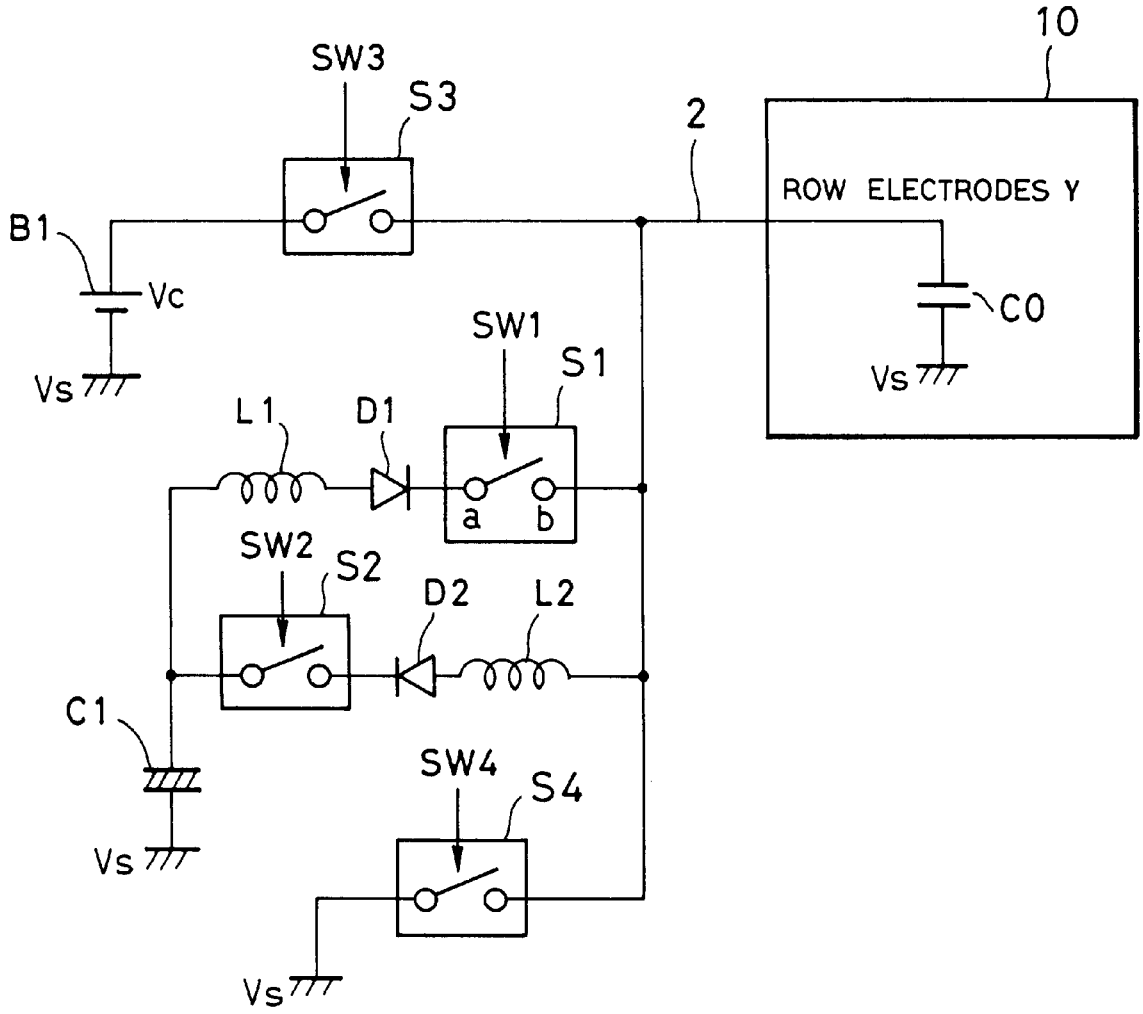
FIG. 3 is a diagram illustrating a drive pulse generator provided in a row electrode driver 30.
Figure 4:
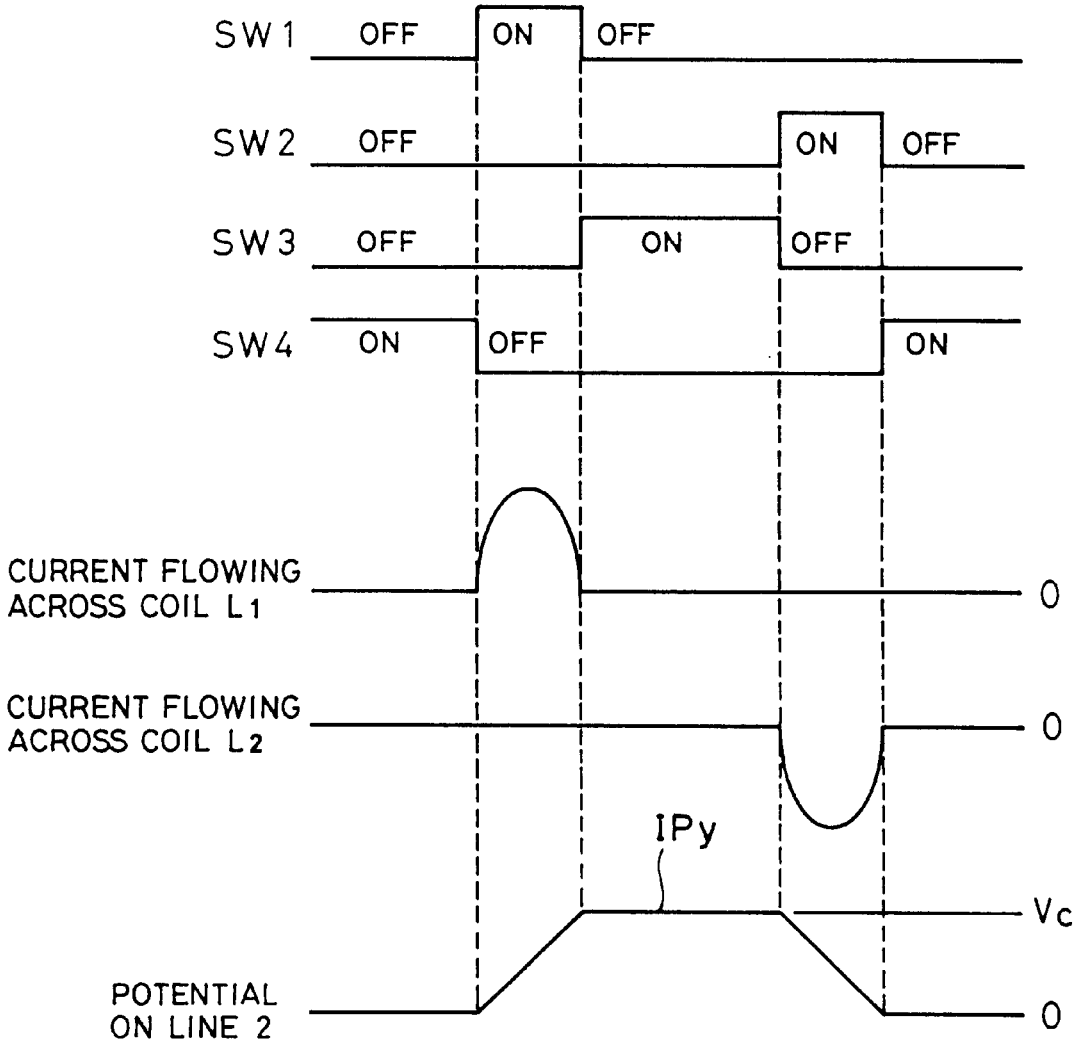
FIG. 4 is a diagram illustrating the operational waveforms of the drive pulse generator shown in FIG. 3.

Because the pulse generator as shown in FIG. 6 can make the voltage value of the DC power supply B lower than the peak value of each drive pulse, as discussed above, it achieves lower power consumption. In addition, the pulse generator can have a smaller circuit scale than the electrode driver as shown in FIG. 3. As the pulse generator requires just a single switching element, it can operate faster than the electrode driver as shown in FIG. 3. Further, the pulse generator is designed to generate pulses using full resonance, it suffers less EMI interference.

Figure 12:
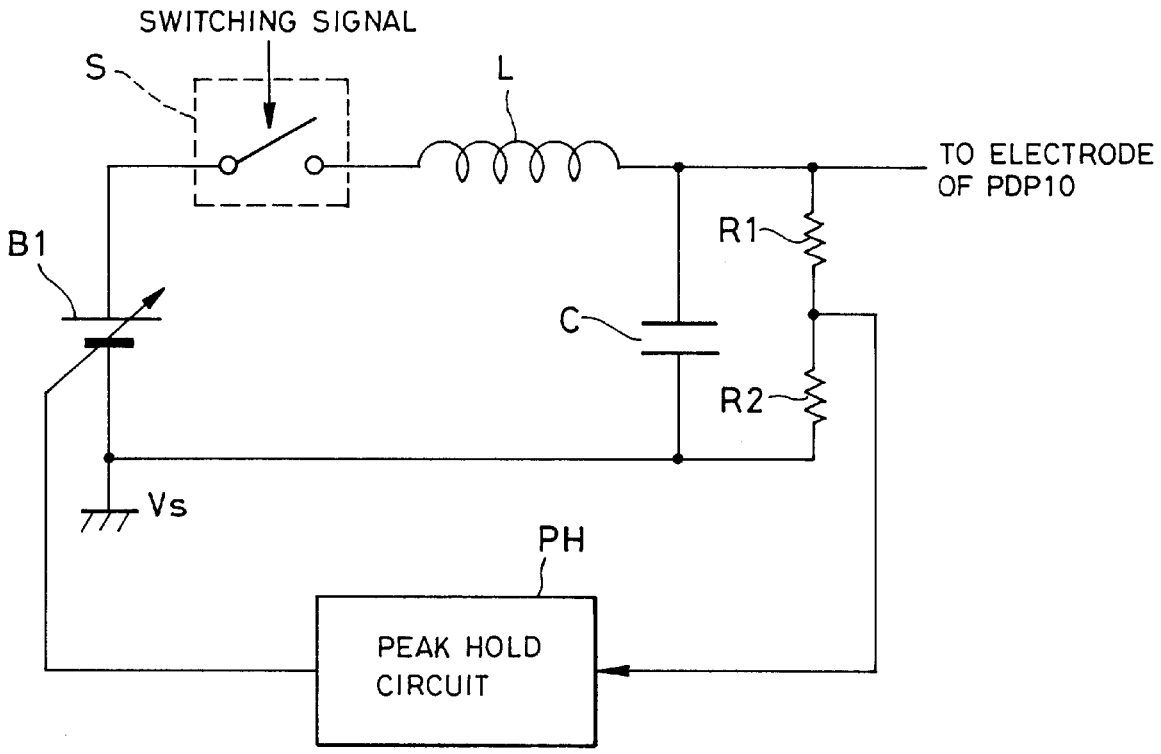
FIG. 12 is a diagram showing a pulse generator having a stabilizing circuit.

FIG. 12 is a diagram showing a pulse generator according to another embodiment of the invention.

The pulse generator shown in FIG. 12 is the generator shown in FIG. 6 to which peak voltage value detection means comprised of a peak hold circuit PH and resistors R1 and R2 is added with the DC power supply B replaced with a variable DC power supply B1. The peak hold circuit PH detects and holds the peak value of the voltage that is generated on the line 2, based on the value that is acquired by dividing the potential difference produced between the line 2 and the PDP ground potential $V_s$ by resistors R1 and R2, and supplies the peak voltage value to the variable DC power supply B1. The variable DC power supply B1 generates a DC supply voltage according to the peak voltage value and the generated voltage is applied to the series circuit of the coil L and the capacitor C.

The structure adjusts the value of the DC supply voltage that is generated by the variable DC power supply B1 in such a way that the peak value of the drive pulse generated on the line 2 always becomes stable at the desired constant value. That is, the peak value of the drive pulse is detected sequentially and the value of the supply voltage generated by the variable DC power supply B1 is adjusted by the detected peak value, thus stabilizing the peak value of the drive pulse.

The use of the pulse generator shown in FIG. 12 prevents the capacitance of the resonance capacitor from becoming insufficient due to the discharge current particularly when a large PDP is driven, and can thus make the peak value of the drive pulse stable.

Instead of using the value of the supply voltage, the ratio of the period of closing the switching element S to the period of opening it may be adjusted in accordance with the peak voltage value.

As apparent from the above, since the driving apparatus for a display panel according to the present invention can generate various kinds of drive pulses from a DC power supply whose voltage value is lower than the peak value of each drive pulse to be generated, the apparatus can reduce power consumption. As the driving apparatus requires only one switching element, it can have a smaller circuit scale and faster operation. In addition, the driving apparatus is so constructed as to generate drive pulses using full resonance, it advantageously has less EMI interference.

What is claimed is:

1. A driving apparatus for a display panel having a plurality of row electrodes and a plurality of column electrodes intersecting said row electrodes, for generating a drive pulse to be applied to each of said electrodes, comprising:

a DC power supply for generating a DC voltage and having a positive terminal and a negative terminal, one of said positive terminal and negative terminal applied with a reference potential;

a coil having a first end connected to the other terminal of said DC power supply and switching means for alternately making a connection and disconnection between said first end of said coil and said other terminal of said DC power supply, wherein said drive pulse is generated on a second end of said coil by connecting said one terminal of said DC power supply to said first end of said coil by said switching means during a period equivalent to one resonance period determined by capacitive elements of said coil and said display panel.

2. The driving apparatus according to claim 1, further comprising:

peak-voltage detection means for detecting a peak voltage value of said drive pulse; and stabilizing means for maintaining a peak value of said drive pulse at a constant value in accordance with said peak voltage value.

3. The driving apparatus according to claim 1, wherein said drive pulse is a sustain pulse applied to said row electrodes.

4. The driving apparatus according to claim 1, wherein said drive pulse is a pixel data pulse applied to an associated one of said column electrodes.

* * * * *